US007284544B2

(12) United States Patent
Hatano

(10) Patent No.: US 7,284,544 B2
(45) Date of Patent: Oct. 23, 2007

(54) EXHAUST GAS RECIRCULATION APPARATUS

(75) Inventor: Kenta Hatano, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 21 days.

(21) Appl. No.: 10/573,782

(22) PCT Filed: May 27, 2005

(86) PCT No.: PCT/JP2005/009787

§ 371 (c)(1),
(2), (4) Date: Mar. 28, 2006

(87) PCT Pub. No.: WO2006/027878

PCT Pub. Date: Mar. 16, 2006

(65) Prior Publication Data

US 2006/0278204 A1 Dec. 14, 2006

(30) Foreign Application Priority Data

Sep. 3, 2004 (JP) ..... 2004-257388

(51) Int. Cl.
*F02M 25/07* (2006.01)
*F02B 47/08* (2006.01)
*F28F 27/02* (2006.01)

(52) U.S. Cl. ..... 123/568.12; 123/568.21; 165/103

(58) Field of Classification Search ..... 123/568.11, 123/568.12, 568.21; 60/605.2; 165/103
See application file for complete search history.

(56) References Cited

U.S. PATENT DOCUMENTS

| | | | | |
|---|---|---|---|---|
| 4,723,528 | A | 2/1988 | Tamura | |
| 5,203,311 | A * | 4/1993 | Hitomi et al. | 60/605.2 |
| 5,546,915 | A | 8/1996 | Isobe | |
| 5,617,726 | A * | 4/1997 | Sheridan et al. | 60/605.2 |
| 5,732,688 | A * | 3/1998 | Charlton et al. | 123/568.12 |
| 6,718,956 | B2 * | 4/2004 | Klipfel et al. | 123/568.12 |
| 6,868,840 | B2 * | 3/2005 | Lewallen | 123/568.12 |
| 6,976,480 | B2 * | 12/2005 | Miyoshi et al. | 123/568.12 |
| 7,032,577 | B2 * | 4/2006 | Rosin et al. | 123/568.12 |
| 2005/0199381 | A1 * | 9/2005 | Mercz et al. | 123/568.12 |

FOREIGN PATENT DOCUMENTS

JP 61-38152 A 2/1986

(Continued)

*Primary Examiner*—Willis R. Wolfe, Jr.
(74) *Attorney, Agent, or Firm*—Birch, Stewart, Kolasch and Birch, LLP

(57) ABSTRACT

An exhaust gas recirculation device includes: an exhaust gas recirculation passage of an engine; an EGR cooler provided within this exhaust gas recirculation passage; a bypass passage connected between the upstream and the downstream sides of the EGR cooler in the exhaust gas recirculation passage; an EGR valve provided within the exhaust gas recirculation passage on the downstream side of the EGR cooler; a bypass valve for opening and closing the bypass passage; and a valve controlling unit determining the timing period of flowing the high-temperature exhaust gas diverted from the EGR cooler into the EGR valve, and switchingly controlling the bypass valve such that during the timing period, the high-temperature exhaust gas is diverted from the EGR cooler and flown into the EGR valve through the bypass passage, and except during the timing period, the high-temperature exhaust gas is flown into the EGR valve to be circulated.

6 Claims, 2 Drawing Sheets

FOREIGN PATENT DOCUMENTS

| | | | |
|---|---|---|---|
| JP | 62-203969 | A | 9/1987 |
| JP | 8-61156 | A | 3/1996 |
| JP | 10-47171 | A | 2/1998 |
| JP | 10-299579 | A | 11/1998 |
| JP | 11-280565 | A | 10/1999 |
| JP | 2003-97361 | A | 4/2003 |

* cited by examiner

EXHAUST GAS RECIRCULATION APPARATUS

TECHNICAL FIELD

The present invention relates to an exhaust gas recirculation device having a deposit removing function.

BACKGROUND ART

In a conventional exhaust gas recirculation device, the device having a structure in which an exhaust gas recirculation passage (hereinafter, referred to as EGR pipe) is connected to an intake-and-exhaust passage of an engine and the EGR pipe is equipped with an EGR valve alone has the disadvantage that deposits such as suspended matters contained in the circulating exhaust gas deposit on the inner peripheral surface of the EGR pipe and the valve-rod sliding area of the EGR valve and further, there arise pressure losses and malfunctions of the EGR valve, caused by the deposit deposition thereon. For this reason, an exhaust gas recirculation device has been already known, in which for the purpose of only removing the deposits, the downstream side of the EGR pipe and the exhaust passage are connected or associated by a bypass passage, the connection between the bypass passage and the EGR pipe is equipped with a switching valve, and this switching valve and the EGR valve are controlled in switching operation to bring, during a non-EGR operation, the high-temperature exhaust gas to burn and remove the deposits adhered to the inner wall during an EGR operation (see, for example, JP-A-10-299579, pp. 4-5, and FIG. 1). Also, an exhaust gas recirculation device has been already known, which is equipped with an EGR cooler placed in the exhaust gas recirculation passage in order to cool the high-temperature exhaust gas and circulate the gas to the engine intake side (see, for example, JP-A-2003-097361, Abstract, and Selected Drawing).

Patent Reference 1: JP-A-10-299579

Patent Reference 2: JP-A-2003-097361

The conventional exhaust gas recirculation devices are configured as mentioned above. In the case of JP-A-10-299579, the high-temperature exhaust gas is schemed to flow from the bypass passage into the EGR pipe through the exhaust passage during the non-EGR operation to thereby burn and remove the deposits adhered to the inner wall of the EGR pipe, and the EGR pipe is not provided with an EGR cooler. Because of this, an effect other than the deposit removal performed by the high-temperature exhaust gas, that is, the effect of cooling the high-temperature exhaust gas and circulating the cooled gas to the engine-intake side cannot be achieved. Furthermore, there is a problem that the EGR valve and the switching valve are susceptible to heat due to the high-temperature exhaust gas. Moreover, in the case of JP-A-2003-097361, the device is provided with an EGR cooler, and is arranged to open and close the bypass valve only when the warming up is accelerated and stabilized. Consequently, there is a problem that the high-temperature exhaust gas containing steam, unburned gas and oil passes through the EGR cooler, and thereby, condensed deposits adhere to the EGR valve, thus causing the EGR valve to stick. It is seemingly effective to incorporate the EGR cooler described by JP-A-2003-097361 into the EGR pipe described by JP-A-10-299579; in this case, because the exhaust gas cooled by the EGR cooler is, however, circulated to the exhaust passage through the exhaust passage, the exhaust gas cooled by the EGR cooler cannot be circulated to the intake side of the engine. As a result, there arises a serious problem that the incorporation is impractical.

The present invention has been accomplished to solve the above-mentioned problems. An object of the present invention is to provide an exhaust gas recirculation device that can cool the high-temperature exhaust gas and circulate the cooled gas to the engine-intake side, and, in spite of the fact, that can remove the deposits adhered to the exhaust gas recirculation passage and valve by the high-temperature exhaust gas, the device having improved reliability and durability because of the reduction of the pressure loss caused by the deposits.

DISCLOSURE OF THE INVENTION

An exhaust gas recirculation device according to the present invention includes: an exhaust gas recirculation passage of an engine; an EGR cooler provided within this exhaust gas recirculation passage; a bypass passage connected between the upstream side and the downstream side of said EGR cooler provided within said exhaust gas recirculation passage; an EGR valve provided within the exhaust gas recirculation passage on the downstream side of said EGR cooler; and a bypass valve for opening and closing the bypass passage; and the exhaust gas recirculation device further includes a valve controlling means that has a function determining the timing period of flowing the high-temperature exhaust gas diverted from said EGR cooler into said EGR valve, and the valve controlling means that controls in switching operation said bypass valve such that during the timing period, said high-temperature exhaust gas is not passed through said EGR cooler, but flown into said EGR valve through said bypass passage, and except during said timing period, the high-temperature exhaust gas is passed through said EGR cooler to be circulated.

In such a way, it is arranged that in the exhaust gas recirculation passage where the EGR cooler is provided, the upstream and downstream sides of said EGR cooler are connected or associated by the bypass passage; by the valve controlling means used for controlling in switching operation the bypass valve for opening and closing this bypass passage, the timing period of flowing the high-temperature exhaust gas diverted from said EGR cooler into said EGR valve is set; and during the timing period, said high-temperature exhaust gas is diverted from said EGR cooler and flown into said EGR valve through said bypass passage. For this reason, there is an effect that it is possible to remove the deposits adhered to the exhaust gas recirculation passage, the EGR valve, and the bypass valve can be removed with the high-temperature exhaust gas to burn and dry the deposits only during said timing period, to thereby achieve an improvement of the pressure loss caused by the deposits and improve reliability and durability of the exhaust gas recirculation device. Moreover, because only during said timing period the high-temperature exhaust gas is circulated to the downstream side of the EGR cooler, there is an effect that said timing period can be set within the range where the EGR valve and bypass valve are thermally unaffected.

BEST MODE FOR CARRYING OUT THE INVENTION

An embodiment of the present invention will now be described in accordance with the drawings in order to make description in further detail of the present invention.

Embodiment 1

Figure 1:
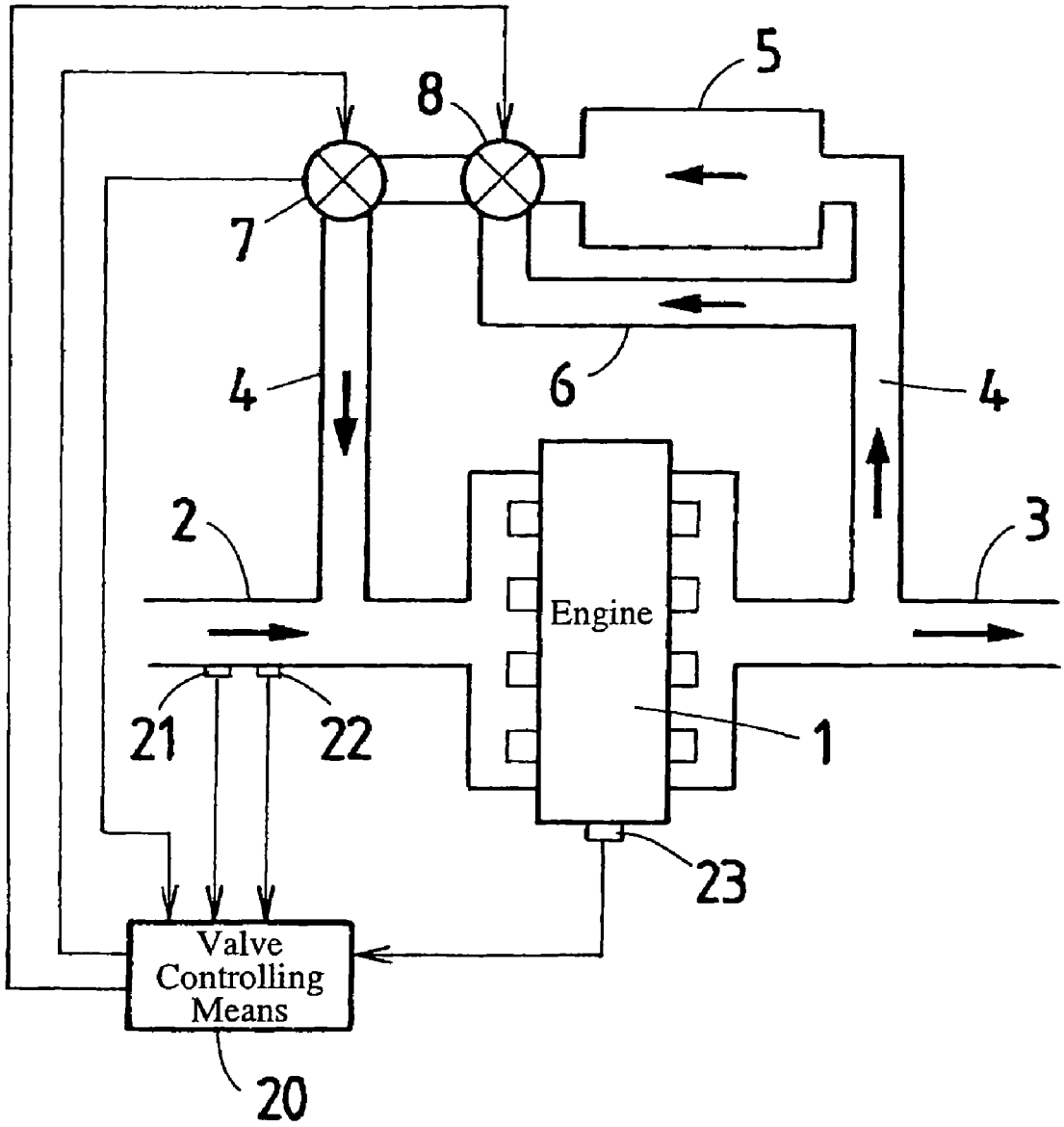
FIG. 1 is a schematic diagram for explaining the fundamental structure of an exhaust gas recirculation device in accordance with Embodiment 1 of the present invention.
Figure 2:
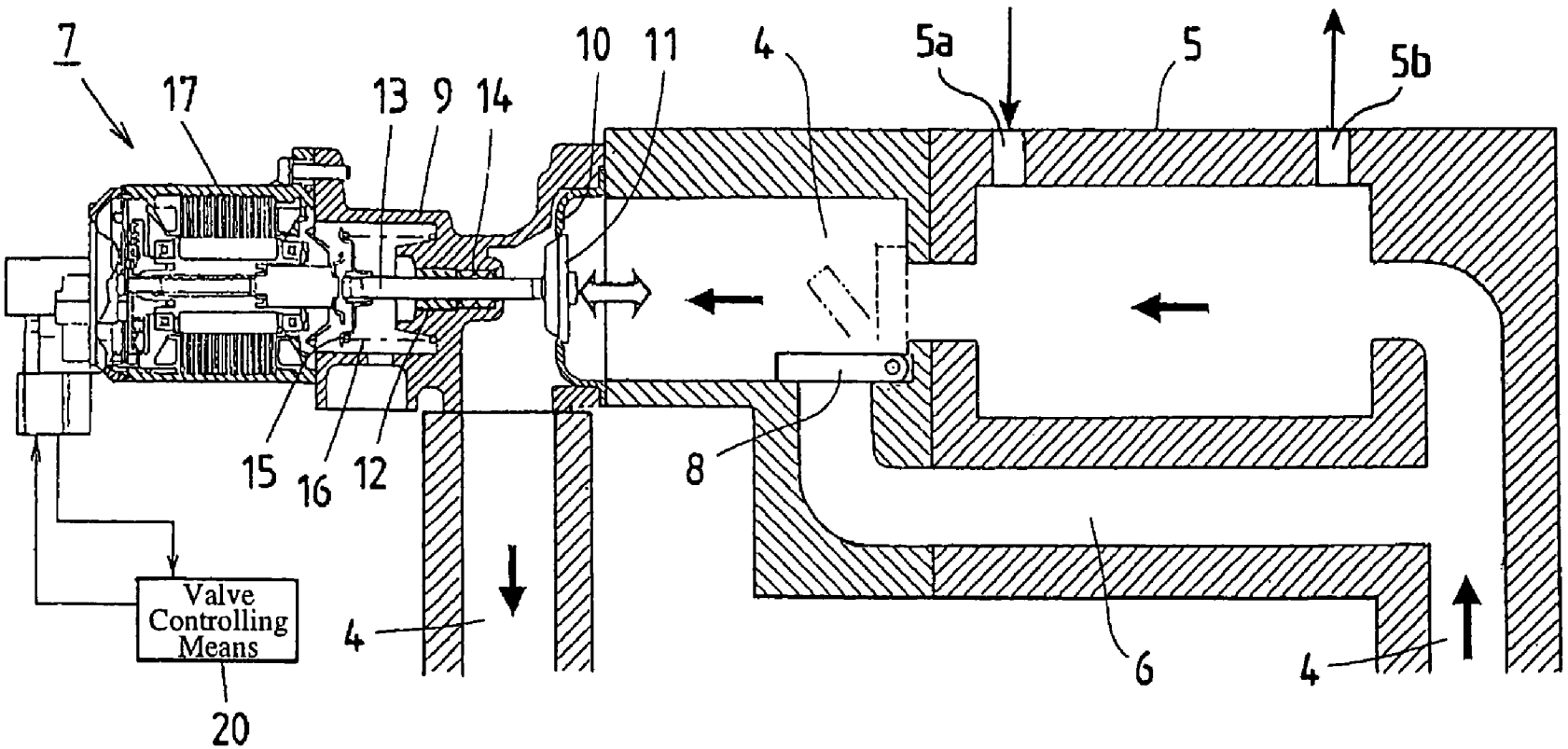
FIG. 2 is an enlarged sectional view of the EGR valve shown in FIG. 1.

FIG. 1 is a schematic diagram for explaining the fundamental structure of an exhaust gas recirculation device in accordance with Embodiment 1 of the present invention, and FIG. 2 is an enlarged sectional view of the EGR valve shown in FIG. 1.

The exhaust gas recirculation device according to the present invention includes, as shown in FIG. 1, an exhaust gas recirculation passage (hereinafter referred to as EGR pipe) 4 that connects or associates the intake passage 2 and the exhaust passage 3 of an engine 1, and this EGR pipe 4 is provided with an EGR cooler 5. This EGR cooler 5 has a structure in which, for example, one end of each of many pipes (not shown) juxtaposed in spaced relationship collects in a single pipe, the single pipe is connected with a cooling water inlet port 5*a*, the other end of each of the pipes collects in another single pipe, and the single pipe is connected with a cooling water outlet port 5*b*. The exhaust gas is flown through the spaces between the pipes to be cooled. In the EGR pipe 4 having such an EGR cooler 5, a bypass passage 6 is connected with the upstream side and the downstream side of the EGR cooler 5. Moreover, the EGR pipe 4 is provided with an EGR valve 7 located on the downstream side of the EGR cooler 5. Herein, the downstream side of the bypass passage 6 is connected with the EGR pipe 4 located between the EGR cooler 5 and the EGR valve 7, and the juncture thereof is provided with a bypass valve 8.

The bypass valve 8 has a valve structure in which the valve can be alternatively switched to the following: a valve position where the bypass passage 6 is intercepted and the EGR cooler 5 is connected to the EGR valve 7; a valve position where the downstream side of the EGR cooler 5 (the outlet port of the cooled exhaust gas) is intercepted and where the bypass passage 6 is connected to the EGR valve 7; or a valve position where the EGR cooler 5 and the bypass passage 6 are each connected to the EGR valve 7 in predetermined opening degrees of the bypass valve.

As shown in FIG. 2, the EGR valve 7 is arranged to include: a valve housing 9 forming a portion of the EGR pipe 4 on the downstream sides of the EGR cooler 5 and the bypass valve 8; a valve sheet 10 provided within this valve housing 9; a valve 11 that is contacted with or separated from this valve sheet 10; a valve rod 13 that is linked or coupled with this valve 11 and is slidably insertion-supported in an axial direction through the valve housing 9 through a bush 12; a filter (deposit scraping means) 14 that is provided through the insertion-supporting portion of the valve rod 13, and scrapes the deposits adhered to the valve rod 13 while the valve 11 is operating; a spring holder 15 installed around the valve rod 13; a spring 16 that is interposed between the spring holder 15 and the inner wall of the valve housing 9, and energizes the valve 11 in the direction to close the valve; and an actuator 17 such as a stepping motor that drives the valve rod 13 in the direction to open the valve against the force of the spring 16.

In addition, the EGR valve 7 and the bypass valve 8 are adapted to be controlled in switching operation by a common valve controlling means (ECU) 20 into which a variety of detection information is inputted. More specifically, the valve controlling means 20 has the following functions: detecting a variety of information such as the pressure, temperature, air flow rate of the intake passage 2, and the engine speed or number of revolution, and inputting the information therein to determine the amount of EGR; controlling the opening degree of the EGR valve 7 such that the valve opening degree is determined based on the determined amount of EGR; judging, when the flow rate of EGR has reduced relative to the opening degree of the EGR valve 7, that the reduction of the flow rate is the reduction of the flow rate caused by the deposit deposition on the EGR valve 7 to determine the timing of flowing the high-temperature exhaust gas, which does not pass through the EGR cooler 5, into the EGR valve 7; intercepting the EGR cooler 5 to the EGR valve 7 when determining the timing (timing period); and imparting open motion to the bypass valve 8 to the valve position to connect the bypass passage 6 to the EGR valve 7.

Accordingly, the valve controlling means 20 inputs the detection signals therein from a variety of sensors such as a pressure sensor 21 and a temperature sensor 22 both disposed in the intake passage 2, an air flow rate sensor (not shown), and an engine speed sensor 23, and controls in switching operation the EGR valve 7 and the bypass valve 8 as previously stated. At this point, information is detected, which judges whether or not the deposits have deposited in the exhaust gas recirculation passage 4 on the downstream side of the EGR cooler 5 according to the signals obtained from the pressure sensor 21, temperature sensor 22, air flow rate sensor, and engine speed sensor 23. The valve controlling means 20 inputs therein the deposit detecting signals detected by such a deposit-adhesion detecting system, and thereby, the valve controlling means 20 compares the input values from the deposit-adhesion detecting system with the opening degree of the EGR valve 7. As a result, when the valve controlling means judges that the amount of recirculation of the exhaust gas has reduced relative to the opening degree of the EGR valve 7, the valve controlling means takes the judging time as the timing period to switch the bypass valve 8, and controls the system such that the high-temperature exhaust gas is not flown into the EGR cooler 5, but flown from the bypass passage 6 into the EGR valve 7.

The operation will now be described as below.

When the engine 1 is normally driven, the device is in the state where the bypass valve 8 intercepts the bypass passage 6 as shown in full line in FIG. 2, and where the outlet port of the EGR cooler 5 for the cooled exhaust gas is opened. In this state, the high-temperature exhaust gas passes through the EGR cooler 5 from the exhaust passage 3 to thus be cooled. This cooled exhaust gas is circulated to the intake passage 2 while the amount of EGR is adjusted by the EGR valve 7 (valve 10). During the gas circulation, when the valve controlling means 20 judges, based on the inputted information from the various sensors, that the amount of EGR has reduced relative to the opening degree of the EGR valve 7, the valve controlling means determines the timing period of flowing the high-temperature exhaust gas, diverted from or not passing through the EGR cooler 5, into the EGR valve 7. At the timing period, the bypass valve 8 inputs therein the output control signal from the valve controlling means 20, and thereby, the bypass valve 8 is switched to the valve position, shown by broken lines in FIG. 2, at which the outlet port of the EGR cooler 5 for the cooled exhaust gas is intercepted and the bypass passage 6 is released. Thus, the high-temperature exhaust gas, branched from the exhaust passage 3, is diverted from the EGR cooler 5, and passes through the bypass passage 6 to be circulated into the intake passage 2 through the bypass valve 8.

In such a manner, when the high-temperature exhaust gas diverted from the EGR cooler 5 is circulated therethrough, the deposits adhered to the valve rod 13 of the EGR valve 7 and the inner wall of the exhaust gas recirculation passage 4 are burned, removed or dried to be easily stripped or come off. This period of time circulating the high-temperature exhaust gas is previously set in the valve controlling means 20, and after a set period of time has elapsed, the output control signal from the valve controlling means 20 puts the actuator 17 in motion to make the valve rod 13 reciprocatingly slide, and scrape and remove the dried deposits adhered to the valve rod 13 with the filter 14. Further, the dried deposits adhered to the valve sheet 10 and the valve 11 are also removed by repeated seating operations of the valve 11 on the valve sheet 10.

According to Embodiment 1 described above, it is arranged that the upstream side and the downstream side of the EGR cooler 5 in the exhaust gas recirculation passage 4 where the EGR cooler 5 is provided be connected or associated by the bypass passage 6; the valve controlling means 20 for controlling in switching operation the bypass valve 8 for opening and closing this bypass passage 6, determine the timing period of flowing the high-temperature exhaust gas diverted from the EGR cooler into the EGR valve, based on the input signals from the various sensors; and the valve controlling means, during the timing period, do not pass the high-temperature exhaust gas through the EGR cooler 5, but flows the gas into the EGR valve 7 through the bypass passage 6. In such a way, there is an effect that the high-temperature exhaust gas diverted from the EGR cooler 5 can burn, remove, or dry the deposits adhered to the exhaust gas recirculation passage 4, EGR valve 7, bypass valve 8, and so on. Further, it is arranged that the insertion-sliding portion of the valve rod 13 in the valve housing 9 is provided with the filter 14 used for scraping the deposits thereon. In this way, there is an effect that by circulating the high-temperature exhaust gas diverted from the EGR cooler 5 therethrough only for the set period, and after the period of circulation has elapsed, the actuator 17 is started up with the output control signal from the valve controlling means 20 to slide reciprocatingly the valve rod 13 therethrough, thereby scraping and removing the deposits adhered to the valve rod 13 with the filter 14.

In addition, according to Embodiment 1, the period of circulating the high-temperature exhaust gas that does not pass through the EGR cooler 5 as described above is previously set in the valve controlling means 20, and the high-temperature exhaust gas is circulated therethrough only for the set period. Thereby, there is achieved an effect that the high-temperature exhaust gas can be circulated within the range where the EGR valve 7 and the bypass valve 8 are thermally unaffected by the high-temperature exhaust gas. Furthermore, it is arranged that after the period of circulation of the high-temperature exhaust gas or during the normal operation of the engine 1, the bypass valve 8 is switched to the valve position in which the bypass passage 6 is closed and the outlet port of the EGR cooler 5 for the cooled-exhaust gas is opened. As a result, there is an effect that the high-temperature exhaust gas is cooled through the EGR cooler 5, and then can be circulated to the intake side of the engine 1.

Embodiment 2

In Embodiment 1, it is arranged that upon removing of the deposit, the bypass valve 8 is controlled to be switched to the valve position in which the outlet port of the EGR cooler 5 for the cooled exhaust gas is completely closed and the bypass passage 6 is completely opened with the output control signal from the valve controlling means 20. However, it can be also arranged that, when determining the timing of circulating the high-temperature exhaust gas based on the signals inputted from the various sensors, the valve controlling means 20 control and open the bypass valve 8 in an opening degree in which the outlet port of the EGR cooler 5 for the cooled exhaust gas and the bypass passage 6 are each connected to the EGR valve 7.

According to Embodiment 2 thus arranged, there is an effect that when the time of circulating the high-temperature exhaust gas is determined by the valve controlling means 20, the cooled exhaust gas, which is the high-temperature exhaust gas cooled by the EGR cooler 5 through which the gas passed, and the high-temperature exhaust gas, which is diverted from the EGR cooler 5 and passes through the bypass passage 6, can be mixed to be flown into the EGR valve 7. As described above, in Embodiment 2, the cooled exhaust gas, which is the high-temperature exhaust gas cooled by the EGR cooler 5 through which the gas passed, and the high-temperature exhaust gas, which is diverted from the EGR cooler 5 and passes through the bypass passage 6 are mixed and circulated. In this way, there is an effect that in comparison with the case where only the high-temperature exhaust gas is circulated, the temperature of the exhaust gas flown into the EGR valve 7 can be controlled to a low temperature within the range in which the EGR valve 7 is thermally unaffected and the deposits can be burned and dried.

Embodiment 3

In Embodiment 3, the valve controlling means 20 is arranged to have an exhaust-gas-temperature controlling function, which, during the time of circulating the high-temperature exhaust gas, detects the period of circulation thereof, the temperature of the exhaust gas, and the operation conditions of the engine 1, and which controls the temperature of the exhaust gas to be flown into the EGR valve 7 based on the detected information. To be more specific, as described also in Embodiment 1, if the high-temperature exhaust gas from the engine 1 is directly flown into the EGR valve 7, the EGR valve 7 is susceptible to a thermal affection such as a thermal breakdown. Because of this, it is arranged that the valve controlling means 20 be provided with the exhaust-gas-temperature controlling function controlling the high-temperature exhaust gas within the temperature range in which the EGR valve 7 is thermally unaffected and the deposits can be burned and dried. Accordingly, in this case, the valve controlling means 20 may be controlled as follows: it is set at the temperature at which the deposits can be burned and dried while the EGR valve 7 is not subjected to a thermal affection (for example, 200° C. to 500° C.); the temperature of the actual exhaust gas is detected with the sensor on the upstream side of the EGR valve 7; the detected temperature signal is inputted therein and compared with the set temperature, so that the temperature of the actual exhaust gas is equal to the set temperature. The controlling means therefor has only to control, for example, when the measured temperature of the exhaust gas flowing into the EGR valve 7 is higher than the set temperature, the flow rate of the cooling water (cooling medium) caused to flow around the EGR cooler 5 such that the temperature of the exhaust gas is within the range of the set temperature.

According to Embodiment 3 described above, the temperature of the high-temperature exhaust gas flown into the EGR valve 7 can be controlled within the temperature range in which the EGR valve 7 is thermally unaffected and the deposits can be burned and dried. As a result, there is an effect that reliability and durability of the exhaust gas recirculation device is improved.

Embodiment 4

In Embodiment 4, with the valve controlling means 20, the period of circulation of the high-temperature exhaust gas flowing into the EGR valve 7 is set within a time period for which the EGR valve 7 does not suffer a thermal breakdown, and it is arranged that the high-temperature exhaust gas be caused to flow into the EGR valve 7 only within the set time period. Herein, because the deposit usually enters a dry state from 200° C., the exhaust gas circulated for removing the deposit must be 200° C. or more. It is arranged that the circulation period of time be set within a short time period (for example, approximately 15 to 30 seconds) for which the EGR valve 7 is not thermally affected, even if the temperature of the high-temperature exhaust gas is 500° C. or more, for example. Therefore, also in Embodiment 4, there is achieved an effect that the deposits adhered to the EGR valve 7 can be efficiently burned or dried by the high-temperature exhaust gas circulated therethrough, and furthermore, the EGR valve 7 does not suffer any thermal breakdown, which improves the reliability and durability of the exhaust gas recirculation device.

INDUSTRIAL APPLICABILITY

As mentioned above, the exhaust gas recirculation device according to the present invention is suitable for removing the deposits deposited in the exhaust gas recirculation passage and valves by the high-temperature exhaust gas.

The invention claimed is:

1. An exhaust gas recirculation device comprising:

an exhaust gas recirculation passage of an engine;

an EGR cooler provided within this exhaust gas recirculation passage;

a bypass passage connected between the upstream side and the downstream side of said EGR cooler provided within said exhaust gas recirculation passage;

an EGR valve provided within said exhaust gas recirculation passage on the downstream side of said EGR cooler; and a bypass valve for opening and closing said bypass passage, and further comprising a valve controlling means that has a function determining the timing period of flowing the high-temperature exhaust gas diverted from said EGR cooler into said EGR valve, and that controls in switching operation the bypass valve such that during said timing period, the high-temperature exhaust gas is not passed through the EGR cooler, but flown into said EGR valve through said bypass passage, and except during said timing period, the high-temperature exhaust gas is passed through said EGR cooler to be circulated.

2. An exhaust gas recirculation device according to claim 1, wherein the bypass valve is provided at the connection between the exhaust gas recirculation passage and the bypass passage in between the EGR cooler and the EGR valve placed on the downstream side of the EGR cooler, and the bypass valve is controlled and alternatively switched by the valve controlling means to the following: a valve position in which the bypass passage is intercepted and the EGR cooler is connected to the EGR valve; a valve position in which the path between said EGR cooler and said EGR valve is intercepted and the bypass passage and said EGR valve are connected to each other; or a valve position in which on the downstream side of said EGR cooler the EGR cooler and said bypass passage are each connected to said EGR valve in the predetermined opening degrees of the valve.

3. An exhaust gas recirculation device according to claim 1, wherein when detecting means of deposit adhesion information located in the exhaust gas recirculation passage on the downstream side of the EGR cooler is judged that the amount of the recirculation of the exhaust gas is reduced in comparison with an opening degree of the EGR valve, the valve controlling means is adapted to take the judged time as the timing period, and control in switching the bypass valve to flow the high-temperature exhaust gas into the EGR valve.

4. An exhaust gas recirculation device according to claim 1, wherein the valve controlling means has an exhaust-gas-temperature controlling function for controlling the temperature of the exhaust gas to be flown into the EGR valve within the range of a set temperature.

5. An exhaust gas recirculation device according to claim 1, wherein a time for flowing the high-temperature exhaust gas is set only during a time range such that the bypass valve and EGR valve are not thermally affected in the timing period.

6. An exhaust gas recirculation device according to claim 1, wherein the valve controlling means is adapted to drive the EGR valve on or after circulation of the high-temperature exhaust gas.

* * * * *